US005984842A

United States Patent [19]

Chu

[11] Patent Number: 5,984,842

[45] Date of Patent: Nov. 16, 1999

[54] BOXING EXERCISE APPARATUS WITH DAMPING ADJUSTMENT

[75] Inventor: Yong S. Chu, Glendale, Calif.

[73] Assignee: Fitness Botics, Inc., Hesperia, Calif.

[21] Appl. No.: 09/098,685

[22] Filed: Jun. 17, 1998

Related U.S. Application Data

[63] Continuation-in-part of application No. 09/038,886, Mar. 11, 1998.

[51] Int. Cl.[6] ..... A63B 69/00

[52] U.S. Cl. ..... 482/83; 482/87; 482/90

[58] Field of Search ..... 482/83–90, 137; 473/441–445

[56] References Cited

U.S. PATENT DOCUMENTS

| | | | |
|---|---|---|---|
| 3,398,953 | 8/1968 | Thompson | 473/445 |
| 3,927,879 | 12/1975 | Long et al. | 482/83 |
| 3,942,796 | 3/1976 | Bowen | 473/441 |
| 4,093,212 | 6/1978 | Jacques | 482/83 |
| 5,108,095 | 4/1992 | Nichols | 482/137 |

FOREIGN PATENT DOCUMENTS

| | | | |
|---|---|---|---|
| 1713606 | 2/1992 | U.S.S.R. | 482/83 |

*Primary Examiner*—Jerome Donnelly
*Attorney, Agent, or Firm*—Gene Scott-Patent Law & Venture Group

[57] ABSTRACT

A boxing exercise apparatus is mounted on a stand. A pivoted support arm provides a strike absorbing means. In a first embodiment, the support arm is connected to the stand with a spring joined to a rigid rod. The rigid rod is preferably positioned in a neutral position with an integral positioning means. Displacement of the support arm away from the neutral position toward a rocked-back position is counteracted by the spring. In a second embodiment, the apparatus further includes a second spring joining segments of the stand so as to bias lateral movement of the support arm. When the support arm is deflected, the first spring and the second spring retards the motion of the support arm within two degrees of freedom. A friction adjustment is provided so as to adjust motion stiffness. This adjustment provides a novel approach using a friction washer.

10 Claims, 5 Drawing Sheets

BOXING EXERCISE APPARATUS WITH DAMPING ADJUSTMENT

This application is a C.I.P. of Ser. No. 09/038,886, Mar. 11, 1998.

BACKGROUND OF THE INVENTION

1. Field of the Invention

The invention relates generally to athletic training equipment, and more particularly to a boxing exercise apparatus useful for striking and punching exercises.

2. Description of Related Art

The following art defines the present state of this field:

Adams et al., U.S. Pat. No. 5,342,267 describes an improved striking device is provided as including a main post having two main longitudinal slots. An insert post having an outside diameter that is less than the inside diameter of the main post is provided. A striking surface is provided that is attached to an arm which in turn is attached to an arm housing. The arm housing has a first housing end and a second housing end. The arm housing is placed around the main post and the second housing end rests upon a support axle passing through the insert post. The first housing end includes a cam surface having two peaks located on opposite sides thereof and two valleys located on opposite sides thereof with each of the two valleys disposed between each of the two peaks. A cam follower is included which is retained in contact against the cam surface by a pair of springs. During rotation of the arm housing the cam follower cooperates with the cam surface of the arm housing to provide a first striking position and a second striking position that are each located on hundred and eighty degrees of rotation apart with respect to each other. As the arm housing rotates the cam surface extends the cam follower which in turn extends the pair of springs in proportion to the contour of the cam surface. If sufficient force is imparted to the striking surface, the arm housing is urged away from the first striking position, and indexes into the second striking position.

Beeman, U.S. Pat. No. 5,464,377 describes a striking target for use in the practice of martial arts including a semi-cylindrical base frame secured to a foundation with the base frame having an upper rim forming a track extending in a substantially horizontal plane. An elbow shaped pivot arm is pivotally mounted radially inward of the track and has a horizontal extension extending over the track and adapted to engage and traverse the track. At least one cam surface is integral the track to form a raise or protuberance and inhibit the movement of the pivot arm across the track. A resilient member is attached to the pivot arm to oppose the force applied to the target member by striking it.

Dong, U.S. Pat. No. 4,836,533 describes a variable tension loaded striking apparatus comprising a base having a pair of spaced upstanding ears between which are disposed a holder portion, the holder portion also being secured at one end of an adjustable air or hydraulic compression device, which at its opposite end is connected to the base of the apparatus. Removably disposed within the holster portion is a striking board which is a plank or similar material adapted to serve as a blow receiving surface.

Tobin, U.S. Pat. No. 4,749,184 describes a kicking practice apparatus including a freestanding support frame having spaced-apart upstanding members mounted at their lower ends to a floor-supported primary base and rigidly connected at their upper ends by a reinforcing structure. The upstanding members are disposed in a generally triangular arrangement. An impact-receiving member has a pivot sleeve mounting the member to a front one of the support frame members such that the impact-receiving member extends in cantilever fashion generally outwardly from the front member and away from a rear pair of the support frame members. The impact-receiving member is pivotable relative to the front member in transverse relation thereto and in either clockwise or counterclockwise directions thereabout. Sets of resiliently yieldable springs and elastic cords extend in opposing relation to one another past and in contact with the pivot sleeve and interconnect the impact-receiving member with the rear pair of members. The springs and cords impose a restoring force on the impact-receiving member and a dampening force on the pivot sleeve for maintaining the impact-receiving member at an initial rest position and returning the impact-receiving member to the rest position with occurrence of only negligible oscillation after pivoting of the impact-receiving member in either direction in response to an impact being applied to the member. Also, the support frame can include a secondary base and bracing members interconnecting the primary base and reinforcing structure with the secondary base to support the upstanding members in including positions.

Prince, U.S. Pat. No. 4,491,316 describes an apparatus for practicing the defense arts such as karate including a frame having a vertical mast member on which a universal support bracket is mounted for supporting articles to be struck by the artisan. The support bracket provides a substantially clear span between portions of the article that are supported to minimize the risk of injury. Detachable target members are adapted for mounting on the universal support bracket and are provided with visual and/or audible indicators for measuring the accuracy and intensity of blows delivered to the target members.

Jacques, U.S. Pat. No. 4,093,212 describes a punching bag usefull in training fighters in developing an effective uppercut includes a vertical member for attachment to the wall having disposed rotatably thereon a horizontal bar containing on its end a padded arm terminating in a rounded portion which simulates the chin of a fighter. The horizontal arm is limited in its downward travel by a hard rubber stop and is biased to the horizontal position by a heavy tension spring but is free to rotate upward against the tension of the spring allowing the training fighter to practice uppercuts on the end thereof and develop the necessary muscles required for such a punch.

Long et al., U.S. Pat. No. 3,927,879 describes a punching bag simulator has a base for mounting on a stationary surface and a spring biased arm pivotally connected to the base and constrained to move only in a single plane with one end of the arm biased by the spring against a resilient bumper. On the other end of the arm a deformable pad is presented for striking by the fists and each time the pad is struck, the arm moves along a lineal path against the spring bias and snaps back to its original position for repeated striking. A pair of resilient bumper elements are placed between the pivoted arm and base in spaced relation to each other. One resilient element serves to absorb kinetic energy of the pivot arm when the pivot arm is moved towards the base against the spring bias and the other resilient element serves to absorb the kinetic energy of a pivot arm when the pivot arm is moved away from the base as a result of the spring bias.

Cummins, U.S. Pat. No. 3,281,148 relates to football practice and conditioning equipment and more particularly to a suspension apparatus for suspending a tackling dummy.

The object of this invention is to provide suspension apparatus for suspending a tackling dummy in such manner that the dummy will react to a charging football player in substantially the same way as a live opponent. A more specific object of the invention is to provide such suspension apparatus having means transferring to a suspended dummy a resistance to free swinging motion similar to the resistance afforded by an opposing player. Another more specific object of the invention is to provide a suspension apparatus having the above characteristics wherein means are provided for effecting an initial resistance which is effective at the moment of contact with a suspended dummy and for providing a lesser, follow-through resistance as the dummy swings away from a charging player.

J.A. Donato, U.S. Pat. No. 3,427,021 describes a striking device having telescopic tubes, one carrying a striking pad at its free end and the other being mounted on a base attachable to a supporting surface, spaced ball bearing assemblies between the tubes at axially spaced locations to provide bearing support and guidance of one tube by the other, a spring disposed within the telescoped tubes to resiliently urge the striking pad away from the base, and cables interconnecting the striking pad and base to limit movement of the striking pad away from the base, the cables having a spring-connected anchor with the base to absorb shock upon rebound of the striking pad away from the base. The telescoping tubes are attached to the base by an angularly adjustable connector. The connector comprises two plates, one attached to the base and having a plurality of holes therein. Attached to the tubes is the second plate which is also pivotally attached to the first plate and has at least one hole therein. A removable pin extends through one of the holes in the first plate and the hole in the second plate to prevent relative angular movement therebetween.

F. Hulsmann, U.S. Pat. No. 885,927 provides this invention relates to punching-bag apparatus of the type wherein the bas is suspended by an arm or rod having a universal mounting in the overhead support and having also a buffer such as a rubber boss, which strikes against a plate of relatively small area, whereby a rebound is secured without causing the bag itself to strike against a ring or platform. Punching-bag apparatus of this character is, as regards the mode of rebound, much less noisy than the rebounding bag style, is less damaging to the bag and its suspending member, and occupies less room but hitherto has been defective in essential particulars which have hindered it practical adoption. This invention aims to overcome. This invention aims to overcome prior defects. Which reside principally in the mode of mounting the suspending rod to give it universal swinging movement; in the absence of adequate means for effecting a quick return of the bag toward its vertical position particularly when struck with only partial force which fails to carry the buffer against the striking plate; and in the absence of proper connections between the bag and its suspending-rod which will allow the bag to be readily inflated and yet afford a durable connection capable of surviving the rough usage administered.

Hoff, DD 285-512-A describes the movable boxing trainer has its own working platform with two rollers. The punch dummy is height-adjustable via a tubular section which is connected to a spring joint. The angle of this is adjusted via a threaded spindle.

Odpo, SU 1507-410-A provides the device comprises a model of a boxer. Its body is covered in soft upholstery. There is a bearing on the body, with concentric rings. The rings are connected to each other by a bolt. Arms are pivoted to the outer ring. Their turning axes are vertical. The arms are spring to the outer ring. Arm movement limiters are fitted on the outer ring. The distance L between the boxing gloves can be varied. When one of the gloves is hit, the other glove hits the boxer if his reaction is slow.

Uype, SU 1713606-A1 provides training device comprises handle, which may be cone-shaped, attached to weight through elastic element. The vertical axis of handle is set at a distance L from the center of mass of weight. An elastic element is suspended on a hinge from a horizontal rod, which is connected to a handle through a threaded bush. The end of the rod has a limiting stop at the end. The sportsman holds the handle with his hand and raises the device. The intensification of training can be increased by oscillating the weight. The device helps simulate the reaction of the opponent's arm to various movements.

The prior art teaches devices which are useful for assisting boxers and martial artists in practicing their striking techniques. However, the prior art inventions are generally not efficient in dampening the force of a strike. The prior art does not teach a simple and light apparatus capable of a wide range of dynamic response characteristics. The prior art also does not teach a strike absorbing apparatus capable of very fast recovery after absorbing a strike. The prior art does not teach such an apparatus enabled for moving laterally after a strike and recovering therefrom. The present invention fulfills these needs and provides further related advantages as described in the following summary.

SUMMARY OF THE INVENTION

The present invention teaches certain benefits in construction and use which give rise to the objectives described below.

The present invention provides embodiments of a boxing exercise apparatus which absorbs the impact of a strike from the hands, arms, legs, feet or head upon the apparatus by the user. The apparatus has a stand providing a base for resting or attaching the apparatus to a floor, wall or ceiling. The stand is hingably connected to a support arm having a strike absorbing means. In a first embodiment, the apparatus moves back and forth while recovering from a strike and the recovery is accelerated by a spring and a rigid rod arrangement. The rigid rod is preferably positioned for contacting and for moving along a sliding surface when the strike absorbing means is deflected toward a rocked-back position thereby causing the spring to retard the motion of the support arm, and whereby the rigid rod is lifted away from the sliding surface when the strike absorbing means is deflected toward a rocked-forward position, again causing the spring to retard the motion. One of the benefits of this embodiment is that only one spring is required. The apparatus may further include a second spring for restoring a neutral position after lateral movement.

A primary objective of the present invention is to provide a boxing exercise apparatus having advantages not taught by the prior art.

Another objective is to provide an apparatus that is smaller and lighter than the prior art.

Another objective is to provide a punching bag means with a greater range of motion then is found in the prior art.

Another objective is to provide an apparatus that can be adjusted to provide a desired deflection characteristic.

A further objective is to provide an apparatus which is critically damped so as to recover its neutral position in as short a time as possible following each strike.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1A:
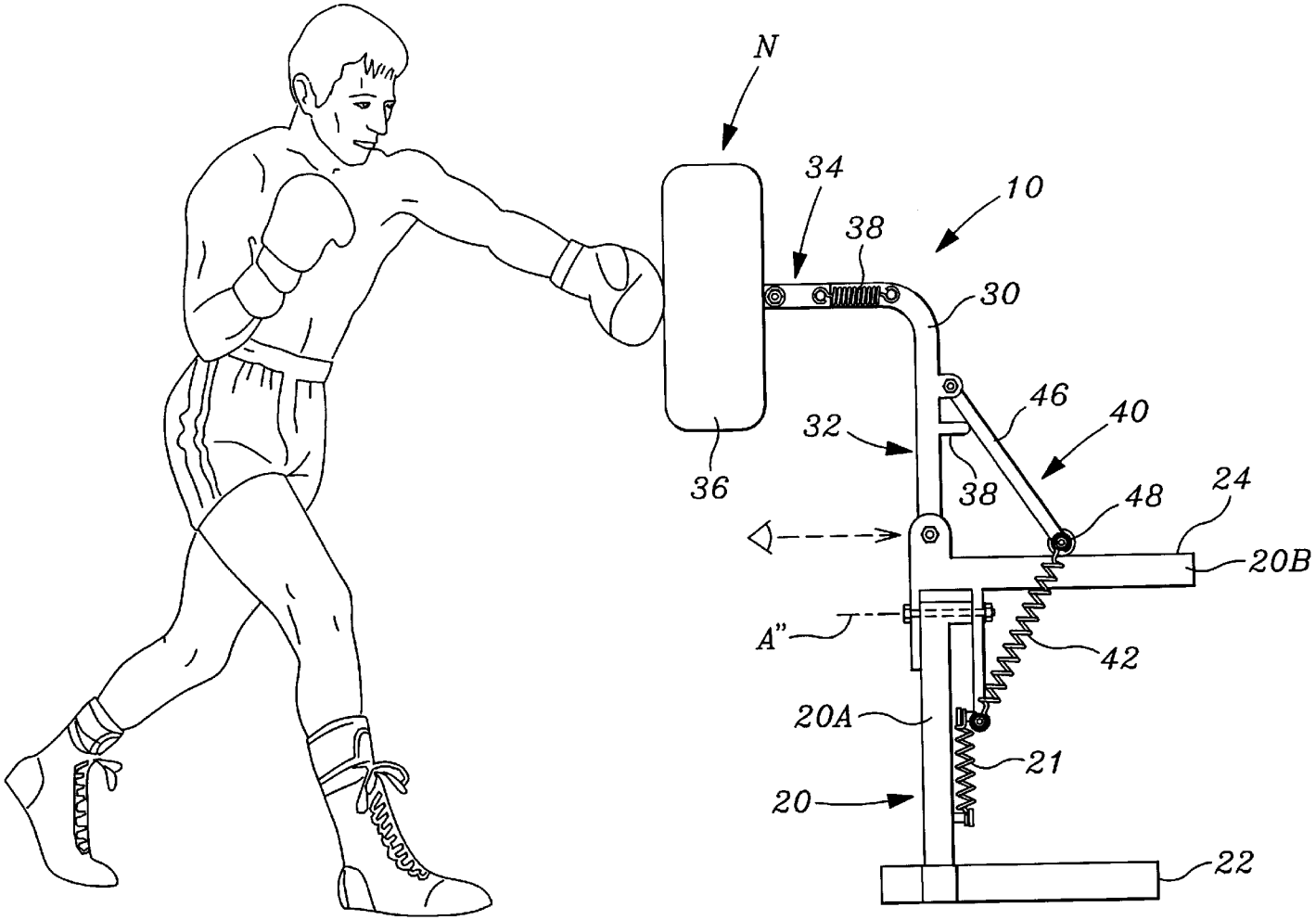
FIG. 1A is a side elevational view of a first embodiment of the present invention, showing a support arm in a neutral position.
Figure 1C:
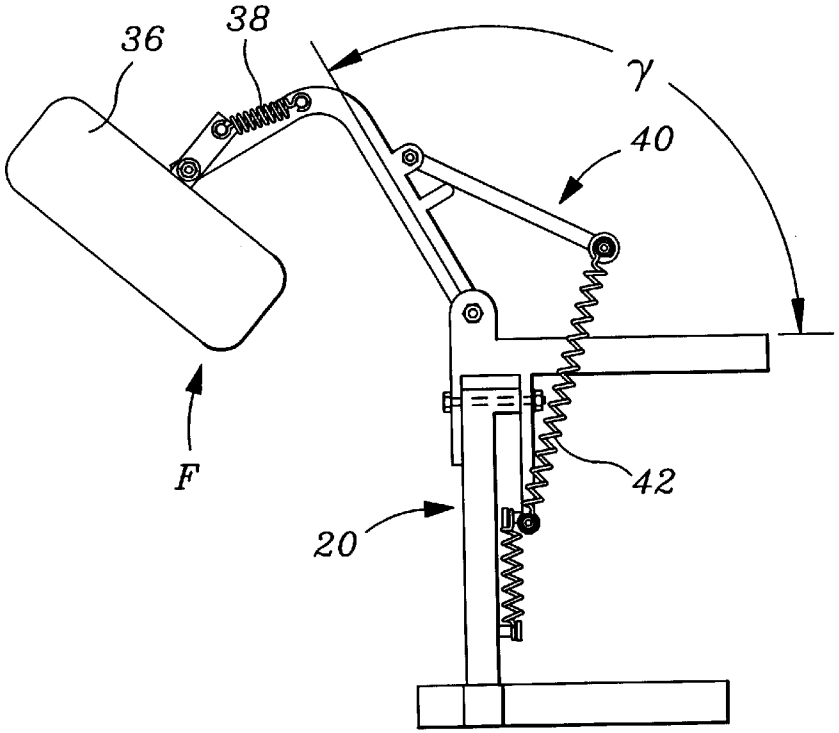
FIG. 1C is similar to FIG. 1L but showing the support arm in a rocked-forward position, and the strike absorbing bag in a rocked down position.
Figure 1B:
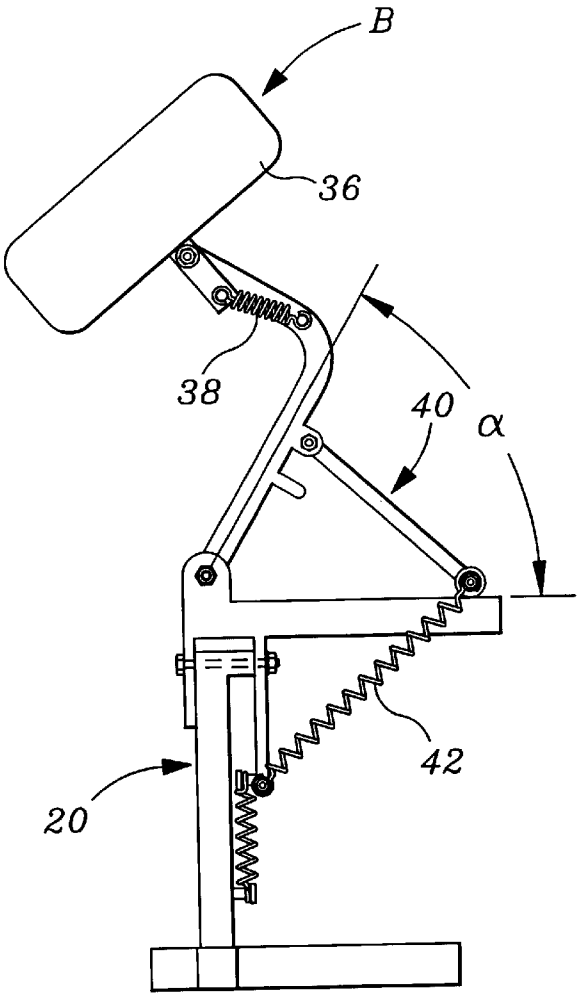
FIG. 1B is similar to 1N but showing the support arm in a rocked-back position and a strike absorbing bag in a rocked up position.

The above described drawing figures illustrate the invention, a boxing exercise apparatus 10. The apparatus 10 has a stand 20 providing a base 22 for resting or attaching the apparatus 10 to a floor, wall or ceiling. Both the stand 20 and the base 22 are preferably made of a structural material such as steel, providing the apparatus 10 with strength, durability, and stability. In a first embodiment, as shown in FIGS. 1N, 1L, 1R, 2N and 2L, the base 22 is placed on or bolted to a supporting surface such as a floor. The weight of the base 22 provides the apparatus 10 with stability; however, the base 22 does not need to be as heavy as similar prior art devices because, as described below, the present invention absorbs much of the energy of the kicking or punching strikes without transmitting energy to the base 22. In a second embodiment, as shown in FIG. 5, the base 22 is, shown as attached to a ceiling, preferably with screws, bolts or similar attachment means.

The apparatus 10 includes a support arm means 30 having a distal end 32 and a proximal end 34. The distal end 32 is hingably engaged with the stand 20 enabling the support arm means 30 to swing from a rocked-back position B (displaced from position N by an angle 90-$\alpha$), shown in FIG. 1L, to a rocked-forward position F (displaced from position N by an angle $\gamma$-90), shown in FIG. 1R where motion is about axis A', see FIG. 2N. A neutral position N defines a rest position of the support arm. The support arm means 30 preferably has a pivoting axle 28 (FIG. 4) integrated at its distal end 32. The stand 20 preferably has a bracket means 26 having an axle receiving hole means 27. The axle 28 rotatably engages the axle receiving hole means 27, achieving a hingable connection between the stand 20 and the support arm means 30. The bracket 26 is preferably a pair of flanges receiving the support arm means 30 between them, and may include a bearing means for low friction engagement, and a friction inducing means for adjusting the friction of motion between the support arm means 30 and the stand 20. In this case, the axle receiving hole means 27 is incorporated in the pair of flanges 26, allowing the axle 28 to rotatably engage the support arm means 30. The neutral position N preferably places the support arm means 30 in a position which is approximately perpendicular to the support surface. A strike absorbing means 36 is attached at the proximal end 34 of the support arm means 30 and is movable therewith. The strike absorbing means 36 preferably has a padded striking surface, although some martial artists may prefer an unpadded surface. The strike absorbing means preferably comprises a rigid backing covered by an energy absorbing pad made of cloth, rubber or plastic material or other appropriate material as is well known. In further possible alternative embodiments, the strike absorbing means 36 may be adapted to meet the individual needs of the user. In such embodiments, various materials might be removably engagable with the support arm means 30 to provide strike absorbing means 36 with an appropriate resilience and texture for boxing or martial arts training. Some of the possible attachments are discussed in Adams, et al., U.S. Pat. No. 5,342,267, which is herein incorporated in full by reference.

A support arm means biasing means 40 comprises a pair of elements which cooperate with each other; an energy storing means 42 joined with a rigid rod means 46. The primary energy storing means 42, preferably a coil spring, is preferably adjustable to provide a selectable level of stiffness (to provide a desired bouncing characteristic) to the movement of the support arm means 30. In its preferred embodiment, the energy storing means 42 can be interchanged with either stronger or weaker springs to accommodate the user's individual requirements. The rigid rod means 46 is preferably a rigid structural rod, preferably having a roller means 48 such as a wheel at the end opposite the support arm means 30. The support arm means biasing means 40 engages, by rolling, at one end with the stand 20 and at the other end, pivotally, with the support arm means 30 so as to urge the support arm means 30 toward the neutral position N. As shown, the rigid rod means 46 is pivotally connected to the support arm means 30 and the primary energy storing means 42 is removably attached to both the rigid rod means 46 and the stand 20. The support arm means 30 provides an integral first elongate positioning means 38 extending outwardly from the support arm means 30 for contacting the rigid rod means 46 so as to position the support arm means 30 with respect to the stand 20. In this configuration, displacement of the support arm means 30, i.e., being rocked forward or backward, is counteracted by the support arm means biasing means 40. The rigid rod means 46 is preferably positioned for contacting and for moving along a sliding surface 24 of the stand 20, preferably on the roller means 48. As shown in FIG. 1L, when the support arm means 30 is rocked back by a punching strike, the energy storing means 42 retards the motion of the support arm means 30. As shown in FIG. 1L, when the support arm means 30 is rocked forward during recovery from a strike, the rigid rod 46 is lifted away from the sliding surface 24 thereby causing the energy storing means 42 to retard the motion of the support arm means 30. Therefore, the strike absorbing means is able to move to the neutral position N very quickly so that another strike may be made with a minimum of waiting. It should be realized that this configuration can be reversed, such that the rigid rod 46 and the first elongate positioning means 38 are connected to the stand 20 and the energy storing means 42 is attached to the support arm means 30, without altering the operation of the invention. Furthermore, instead of using a first elongate positioning means 38, the rigid rod 46 can either be bent or have a finger protruding from it in order to achieve the same result as that shown in the present drawing figures. These many combinations of elements or their equivalents are considered to be within the scope of this invention.

Figure 5:
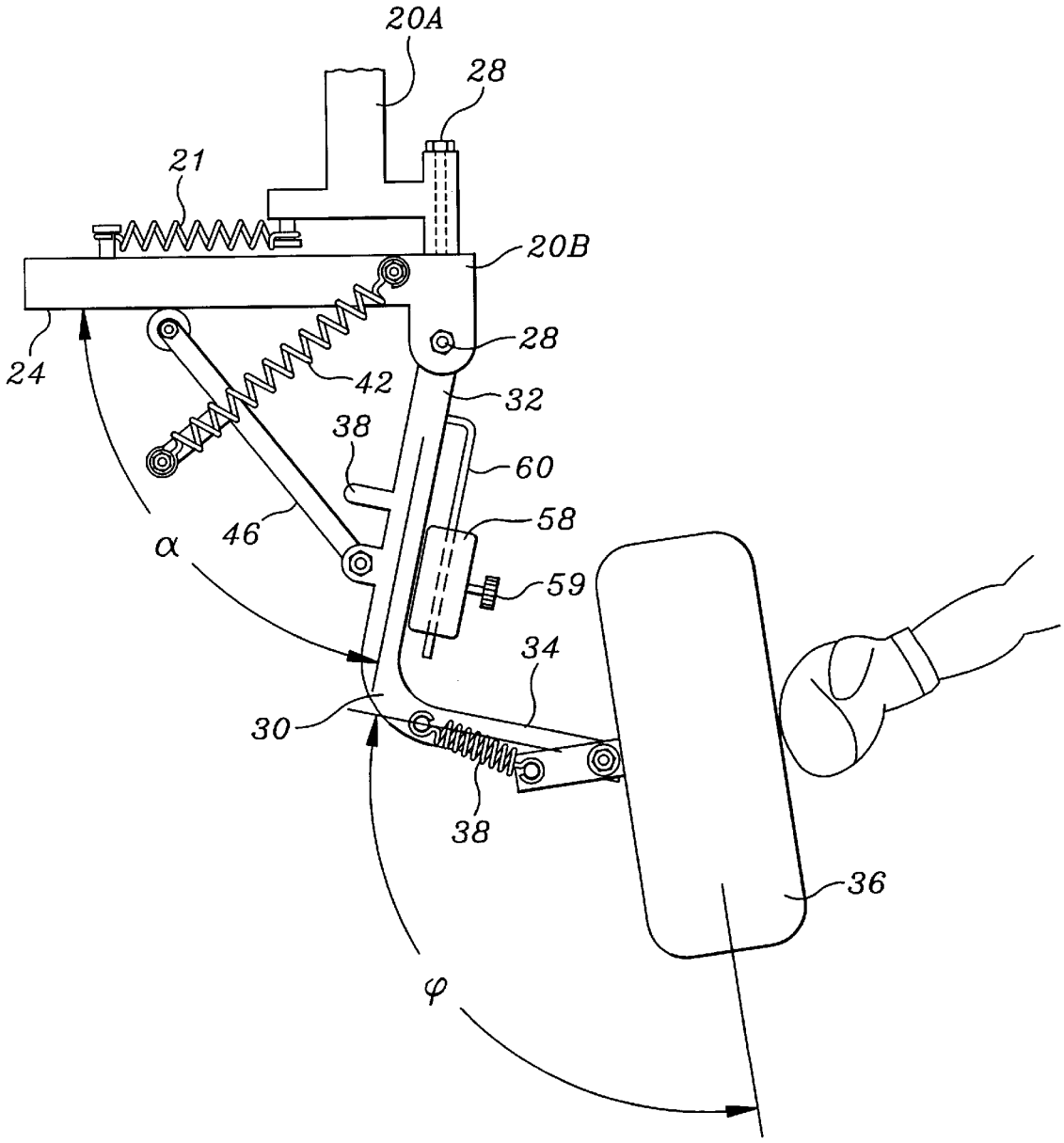
FIG. 5 is a side view of a second embodiment of the invention particularly showing a weight adjustment feature.

As shown in FIG. 5, a weight means 58 may be threadably, or otherwise removably engaged with the support arm means 30 to counterbalance the support arm means 30 for adjusting its stiffness. Selection of the mass of the weight means 58 and its position relative to pivoting axle 28 as well as the spring constant of the energy storing means 42 enables the apparatus 10 to be easily modified to provide a wide range of dynamic characteristics and to extend its use to a wide range of user needs. In FIG. 5 it may be seen that one method of mounting and adjusting the weight means 58 is to place the weight means 58 onto a rod 60 and provide for adjustment via tightening screw 59.

Figure 2A:
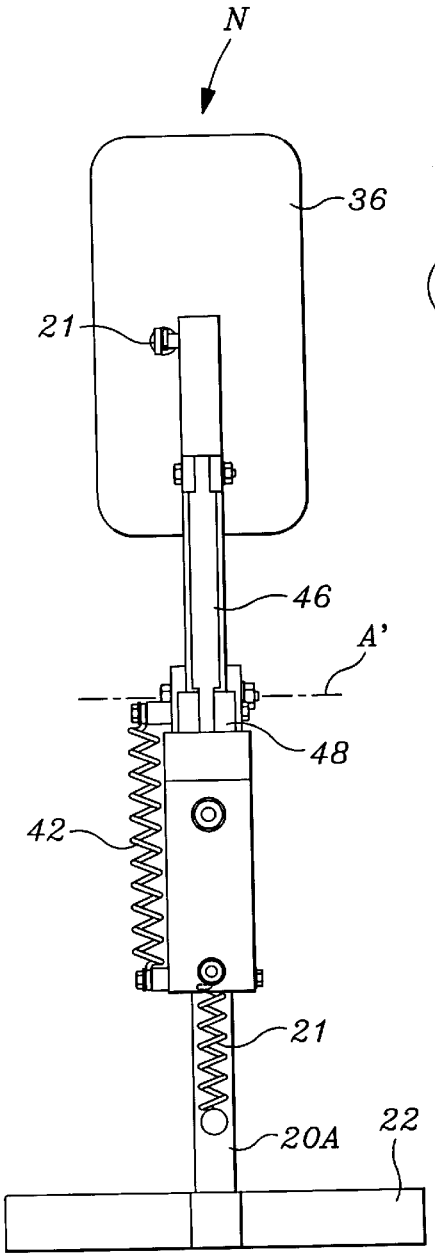
FIG. 2A is a rear elevational view of the first embodiment in the neutral position.
Figure 2B:
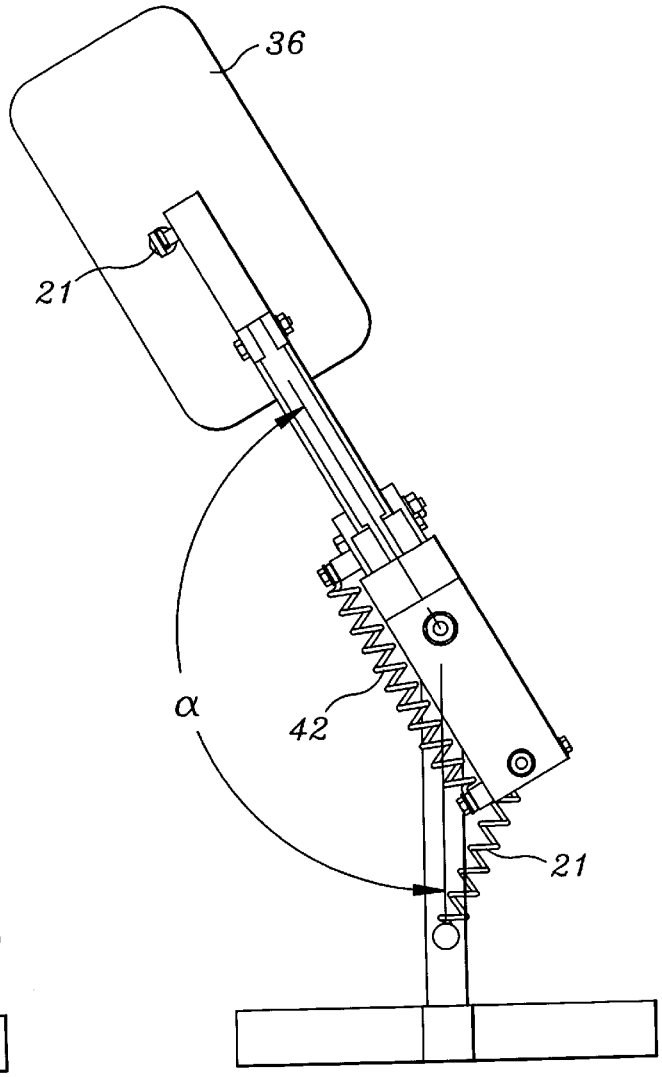
FIG. 2B is a rear elevational view thereof, showing the support arm in a laterally displaced position.

The stand 20 may include a primary stand arm 20A extending from the base 22, and a secondary stand arm 20B pivotally joined to the primary stand arm so as to laterally move with respect thereto; the support arm means 30 being pivotally joined to the secondary stand arm, as described above, and laterally movable therewith. A secondary stand arm biasing means 21 being positioned and engaged for urging the secondary stand arm 20B to position the strike absorbing means 36 toward the neutral position N. This motion is shown in FIG. 2L wherein the upper portion of the machine may move to one side or the other (lateral motion) about pivot axis A" (displaced from position N by an angle $\alpha'$), see FIG. 2L.

Figure 3:
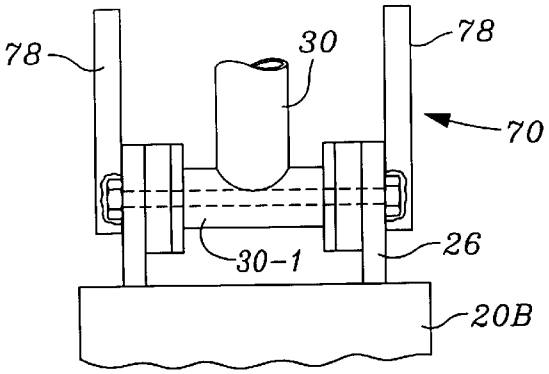
FIG. 3 is a partial front view taken as view 3 shown in FIG. 1N.
Figure 4:
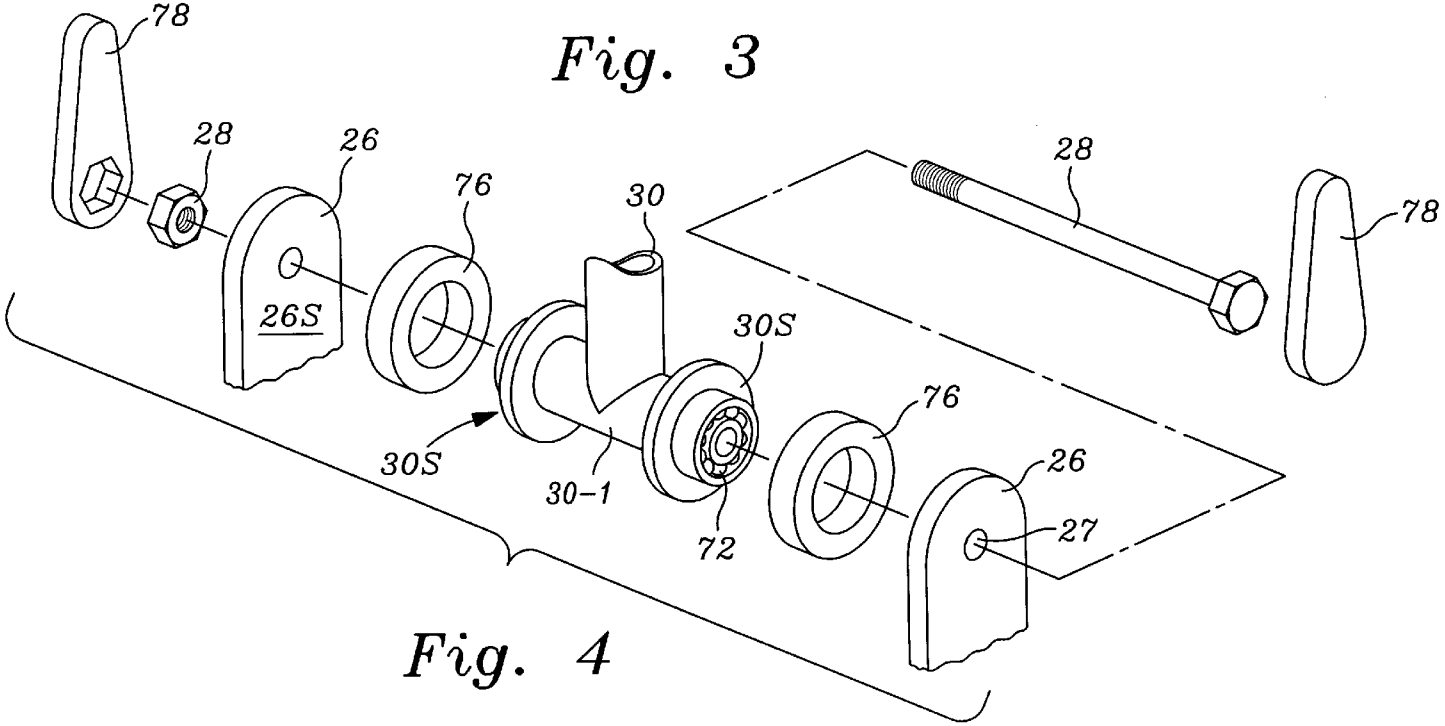
FIG. 4 is an exploded perspective view of FIG. 3.

Preferably, the support arm means 30 is engaged with the secondary stand arm 20B by a rotary joint means 70 (FIG. 3), the rotary joint means 70 providing a bearing means 72, such as a rotary bearing pair as shown in FIG. 4, and a friction inducing means comprising opposing surfaces 26S and 30S and the rubber or composition, (or other high friction material), washer 76 and bolt/nut set 28. The bearing means 72 provides a low friction bearing surface, the friction inducing means provides a high friction bearing surface means and a means for rotational friction adjustment by tightening the bolt/nut set 28. It should be noted that surface 30S is provided by a flange which is integral with the tube 30-1 shown in FIGS. 3 and 4. Other constructions are possible. Preferably, handles 78 are permanently fixed to the head of the bolt/nut 28 as well as the nut itself. These handles 78 afford adjustment of the bolt/nut 28 for adjusting friction in the joint means 70.

The secondary stand arm 20B is preferably engaged with the primary stand arm 20A by the same rotary joint means 70. Also, the strike absorbing means 36 is preferably engaged with the proximal end 34 of the support arm means 30 by the same rotary joint means. Therefore, the strike absorbing means 36 may tilt upward or downward with each strike and the support arm means 30 may move away from the strike and to one side or the other with each strike.

Preferably a strike absorbing means biasing means 38 is positioned and engaged for urging the strike absorbing means toward its neutral position which is shown in FIG. 1N. Tilting of the strike absorbing means is shown in FIGS. 1L and 1R. The mechanical arrangement is well known in the art.

Preferably, the primary and the secondary stand arms 20A, 20B are pivotally joined about a horizontal rotational axis as is shown in FIG. 1N. Also, the rotational axis may be vertical as shown in FIG. 5. In both cases, the lateral motion provides an added degree of freedom to the machine.

The advantage of the present invention is clearly shown in that weight adjustment away or toward the pivot axis provides for adjustment of the mass-moment of the machine. Further, with infinite adjustment of the friction in each of the pivots, the stiffness of the machine may be set for critical damping, i.e., fastest restoration to the neutral position after a strike.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A boxing exercise apparatus comprising:

a stand providing a base for supporting the apparatus;

a support arm means having a distal end and a proximal end, the distal end being hingably engaged with the stand enabling the support arm means to move between a rocked-back position and a rocked forward position, a neutral position thereof dividing the rocked-back and the rocked-forward positions;

a strike absorbing means attached at the proximal end of the support arm means and movable therewith;

a primary biasing means comprising a primary energy storing means joined end-to-end with a rigid rod means, the primary biasing means being pivotally engaged at one end thereof with the stand and at the other end thereof with the support arm means so as to urge the support arm toward the neutral position, the primary energy storing means biasing the rigid rod means to move in contact along a sliding surface of the stand when the support arm means is moved into the rocked-back position, said movement of the rigid rod means being retarded by the primary energy storing means.

2. The apparatus of claim 1 further including a first elongate positioning means joined integrally with the support arm and extending outwardly therefrom so as to contact the rigid rod means only when the support arm means is moved into the rocked-forward position so as to limit the motion of the support arm with respect to the stand.

3. The apparatus of claim 1 further including a weight means removably engagable with the support arm means and positioned for counteracting the motion of the support arm means and for adjusting the stiffness of the support arm means.

4. The apparatus of claim 1 wherein the stand includes a primary stand arm extending from the base, and a secondary stand arm pivotally joined to the primary stand arm so as to laterally move with respect thereto; the support arm means being pivotally joined to the secondary stand arm and laterally movable therewith; a secondary stand arm biasing means being positioned and engaged for urging the secondary stand arm to position the strike absorbing means in a neutral position.

5. The apparatus of claim 4 wherein the support arm means is engaged with the secondary stand arm by a rotary joint means, the rotary joint means providing a bearing means and a friction inducing means, the bearing means providing a low friction bearing surface, the friction inducing means providing a high friction bearing surface means and a means for rotational friction adjustment.

6. The apparatus of claim 1 wherein the secondary stand arm is engaged with the primary stand arm by a rotary joint means, the rotary joint means providing a bearing means and a friction inducing means, the bearing means providing a low friction bearing surface, the friction inducing means providing a high friction bearing surface means and a means for rotational friction adjustment.

7. The apparatus of claim 1 wherein the strike absorbing means is engaged with the proximal end of the support arm means by a rotary joint means, the rotary joint means providing a bearing means and a friction inducing means, the bearing means providing a low friction bearing surface, the friction inducing means providing a high friction bearing surface means and a means for rotational friction adjustment.

8. The apparatus of claim 7 further comprising a strike absorbing means biasing means positioned and engaged for urging the strike absorbing means toward a neutral position.

9. The apparatus of claim 4 wherein the primary and the secondary stand arms are pivotally joined about a horizontal rotational axis.

10. The apparatus of claim 4 wherein the primary and the secondary stand arms are pivotally joined about a vertical rotational axis.

* * * * *